US010875685B2

(12) United States Patent
Luburic et al.

(10) Patent No.: US 10,875,685 B2
(45) Date of Patent: Dec. 29, 2020

(54) CONTAINER LID WITH CASTELLATED CORK

(71) Applicant: BWAY Corporation, Atlanta, GA (US)

(72) Inventors: Frano Luburic, Costa Mesa, CA (US); Forrest A. Burney, LaGrange, GA (US); Christopher James Lung, Santa Ana, CA (US)

(73) Assignee: BWAY Corporation, Atlanta, GA (US)

( * ) Notice: Subject to any disclaimer, the term of this patent is extended or adjusted under 35 U.S.C. 154(b) by 136 days.

(21) Appl. No.: 16/125,281

(22) Filed: Sep. 7, 2018

(65) Prior Publication Data

US 2019/0071223 A1 Mar. 7, 2019

Related U.S. Application Data

(60) Provisional application No. 62/555,395, filed on Sep. 7, 2017.

(51) Int. Cl.

*B65D 43/02* (2006.01)
*B65D 53/02* (2006.01)
*B65D 21/02* (2006.01)

(52) U.S. Cl.

CPC ..... *B65D 43/0212* (2013.01); *B65D 21/0219* (2013.01); *B65D 43/0249* (2013.01); *B65D 53/02* (2013.01); *B65D 2543/005* (2013.01); *B65D 2543/0074* (2013.01); *B65D 2543/00092* (2013.01); *B65D 2543/00296* (2013.01); *B65D 2543/00509* (2013.01);

(Continued)

(58) Field of Classification Search

CPC ..... B65D 21/0219; B65D 21/0222; B65D 21/0223; B65D 21/0217; B65D 53/02; B65D 43/0237; B65D 43/0212; B65D 43/0208; B65D 43/0204; B65D 43/0249

USPC ..... 220/276, 270, 266, 265, 802, 801, 796; 206/509, 507, 505; 215/344, 343, 341, 215/354, 316, 256, 253, 254, 250

See application file for complete search history.

(56) References Cited

U.S. PATENT DOCUMENTS 3,482,725 A * 12/1969 Exton ..... B65D 41/0428 215/337
4,489,845 A * 12/1984 Aichinger ..... B65D 41/0421 215/329

(Continued)

FOREIGN PATENT DOCUMENTS

GB 2001039 A * 1/1979 ..... B65D 41/0428

*Primary Examiner* — Robert J Hicks
(74) *Attorney, Agent, or Firm* — Morris, Manning & Martin, LLP; Daniel E. Sineway, Esq.; Bryan D. Stewart, Esq.

(57) ABSTRACT

In various embodiments, a container lid with a castellated cork seal includes a plurality undulating u-shaped ridges that form peaks and troughs throughout a channel. The undulating u-shaped ridges throughout the channel may provide a surface for receiving a bottom of a separate container in a stacked configuration. In certain embodiments, when the lid is secured on top of a container, the u-shaped ridges protrude downwardly into the container for providing cantilevered support. In particular embodiments, the exemplary container lid includes detachable tear strips along a side wall of the container lid. Removing the tear strips allows access to one or more lift tabs for applying upward leverage to the exemplary container lid for removing the lid from a container.

19 Claims, 8 Drawing Sheets

(52) U.S. Cl.
CPC ..... *B65D 2543/00537* (2013.01); *B65D 2543/00555* (2013.01); *B65D 2543/00629* (2013.01); *B65D 2543/00796* (2013.01); *B65D 2543/00972* (2013.01)

(56) References Cited

U.S. PATENT DOCUMENTS

| | | | | |
|---|---|---|---|---|
| 5,297,688 | A * | 3/1994 | Beck | B65D 41/0421 215/343 |
| 5,450,973 | A * | 9/1995 | Ellis | B65D 41/0421 215/252 |
| 5,803,286 | A * | 9/1998 | Pfefferkorn | B65D 51/1661 215/307 |
| 7,963,419 | B2 | 6/2011 | Burney et al. | |
| 8,181,819 | B2 | 5/2012 | Burney et al. | |
| 2003/0155365 | A1 * | 8/2003 | Llorente Lecue | B65D 43/021 220/802 |

* cited by examiner

CONTAINER LID WITH CASTELLATED CORK

CROSS REFERENCE TO RELATED APPLICATIONS

This application claims the benefit of, and priority to, U.S. Provisional Patent App. No. 62/555,395, filed on Sep. 7, 2017, and entitled "CONTAINER LID WITH CASTELLATED CORK," as if the same was included herein in its entirety.

TECHNICAL FIELD

The present disclosure relates generally to container lids.

BACKGROUND

Generally, containers such as industrial containers are used for transporting and/or storing various materials (e.g., liquids and solids), sometimes in stacked configurations. Conventional lids for these containers may include gaskets for creating seals with the containers, but it is well known that gaskets in typical container lids are prone to failure, may trap liquid or other materials in the gasket, and are generally difficult to manufacture. Moreover, container lids are generally not designed to withstand loads of one or more stacked containers, and stacking containers on conventional lids often results in cracks, bending, and other vulnerabilities in the lids.

Generally, stacking one or more containers upon traditional container lids may eventually break or compromise the structural integrity of small vertical walls/notches included in traditional lid designs, which may further compromise the fidelity of the container lid seal. Other traditional container lids may not include any particular location/lid portion for accepting the bottom of a stacked container, and rather the traditional container lid may accept the entire circumference of the container bottom at the bottom of a u-shaped cork. In this scenario, it is common for the containers to become stuck in the stacked configuration.

Therefore, there exists a long-felt but unresolved need for container lids that provide tight and gasketless seals, can withstand heavy loads, and do not disturb the contents of the container.

BRIEF SUMMARY OF DISCLOSURE

Briefly described and according to one embodiment, aspects of the present disclosure relate generally to container lids, and more particularly to container lids with castellated cork seals. The present embodiments provide improvements over traditional container lids that accept the bottom of a stacked container by providing an undulating cork surface, wherein the bottom of a stacked container is accepted at the portions of the cork surface that are at an elevation above a lower portion of the cork surface.

According to various aspects of the present disclosure, the container lid includes a seal portion for accepting the upper rim of a container, and a u-shaped castellated cork portion for at least partially securing the container lid to the container in a closed position. In one embodiment, the castellated cork includes undulating peaks and troughs (e.g., castellated ridges). In further embodiments, the lid includes a tear strip located along the bottom portion of an outer rim of the container lid. According to at least one embodiment, the container lid is circular in shape. In one or more embodiments, the container lid may be manufactured to fit any container shape (e.g., rectangular, ovoid, etc.).

The container lid discussed herein may be formed in any suitable way. In various embodiments, the container lid is formed by injection molding. In particular embodiments, the container lid is 3D-printed or created via other additive manufacturing techniques. In further embodiments, various components of the container lid are formed or created separately and the various components of the container lid are joined or otherwise suitably connected to form the container lid. In one embodiment, the container lid may be a one piece and unitary lid.

As will be understood by one of ordinary skill in the art, the container lid discussed herein may be used for sealing containers used for storing any variety of materials, including, but not limited to: food, paints, oils, consumer goods, construction materials, inks, chemicals, lubricants, adhesives, coatings, roofing mastics, driveway sealers, flavorings, sanitation supplies, building products, ice melt compounds, powders, pet food, and other such materials. The container lid may be formed from any suitable material or materials for storing or transporting such materials. In various embodiments, the container lid is manufactured from plastic (e.g., polyethylene, high-density polyethylene, etc.). In particular embodiments, the container lid is manufactured from a metal or composite material.

In one embodiment, the present disclosure discusses a gasketless container lid comprising: a top portion; a side portion comprising a detachable tear strip; and a castellated cork seal mechanism, the castellated cork seal mechanism comprising: at least one first portion comprising a substantially u-shaped protrusion extending downwardly from the lid top portion to a first particular depth; and at least one second portion integrally connected to the first portion comprising a substantially u-shaped protrusion extending downwardly from the lid top portion to a second particular depth. In various embodiments, the second particular depth is greater than the first particular depth. In particular embodiments, the castellated cork seal mechanism further comprises at least one third portion, the at least one third portion comprising a substantially flat protrusion extending downwardly from a bottom of the at least one first portion to a third particular depth. According to various aspects of the present disclosure, the third particular depth is substantially the same depth as the second particular depth. In a particular embodiment the third particular depth is not the same depth as the second particular depth.

According to various aspects of the present disclosure, the gasketless container lid further comprises one or more ribs extending downwardly from a bottom of the container lid, a first rib of the one or more ribs integrally formed with at least a portion of the at least one first portion of the castellated cork seal mechanism and perpendicular thereto. In certain embodiments, a second rib of the one or more ribs is integrally formed with at least a portion of the at least one second portion of the castellated cork seal mechanism and perpendicular thereto. In one embodiment, a third rib of the one or more ribs are integrally formed with at least a portion of the at least one third portion of the castellated cork seal mechanism and perpendicular thereto.

In a particular embodiment, the gasketless container lid is substantially circular. In certain embodiments, the container lid is substantially rectangular. According to various aspects of the present disclosure, the castellated cork seal mechanism extends linearly at a position proximate the perimeter of the container lid and in substantially the same shape as the container lid. In a certain embodiment, the side portion extends below a lowest point of the castellated cork seal mechanism. In one embodiment, the detachable tear strip extends below a lowest point of the castellated cork seal mechanism.

In a particular embodiment, a gasketless container lid is disclosed, the gasketless container lid including: a top surface at a first elevation terminating at a perpendicular rim extending upwardly to a second elevation; a seal portion comprising a seal surface at substantially the second elevation terminating at a side wall extending downwardly from the second elevation, wherein the side wall comprises a removably attached tear strip; a cork seal comprising: a first portion extending downwardly from the seal portion substantially perpendicular to the seal surface at the second elevation to a third elevation; and a second portion extending downwardly from the rim at the second elevation, the second portion forming an undulating cork surface between the first portion and second portion, wherein a first section of the undulating cork surface is at the third elevation and a second section of the undulating cork surface is at a fourth elevation.

In one embodiment, the gasketless container lid comprises a channel comprising at least some of the first portion, the second portion, and the undulating cork surface between the seal portion and the rim for receiving a protrusion from a bucket stacked on the container lid. In certain embodiments, the protrusion from the bucket stacked on the container lid rests upon the undulating surface at the fourth elevation. In various embodiments, the fourth elevation is between the first elevation and the third elevation. In particular embodiments, the undulating cork surface slopes from the third elevation to the fourth elevation. According to various aspects of the present disclosure, the container lid further comprises one or more ribs integrally formed with a cork surface of the container lid, the one or more ribs perpendicular to the cork surface and each connected to a least a portion of the channel.

These and other aspects, features, and benefits of the claimed embodiment(s) will become apparent from the following detailed written description of the embodiments and aspects taken in conjunction with the following drawings, although variations and modifications thereto may be effected without departing from the spirit and scope of the novel concepts of the disclosure.

BRIEF DESCRIPTION OF THE DRAWINGS

Further features and benefits of the present disclosure will be apparent from a detailed description of various embodiments thereof taken in conjunction with the following drawings, wherein similar elements are referred to with similar reference numbers, and wherein.

DETAILED DESCRIPTION OF DRAWINGS

The above and further features of the disclosed exemplary container lid will be recognized from the following detailed descriptions and drawings of particular embodiments. In various embodiments, a container lid with a castellated cork is disclosed. In particular embodiments, the lid includes a seal portion for accepting the upper rim of a container, and a u-shaped castellated cork portion for at least partially securing the container lid to the container in a closed position. In one embodiment, the castellated cork includes undulating peaks and troughs (e.g., castellated ridges). In further embodiments, the lid includes a tear strip located along the bottom portion of an outer rim of the container lid. According to at least one embodiment, the container lid is circular in shape. In one or more embodiments, the container lid may be manufactured to fit any container shape (e.g., rectangular, ovoid, etc.).

The container lid discussed herein may be formed in any suitable way. In various embodiments, the container lid is formed by injection molding. In particular embodiments, the container lid is 3D-printed or created via other additive manufacturing techniques. In further embodiments, various components of the container lid are formed or created separately and the various components of the container lid are joined or otherwise suitably connected to form the container lid. In one embodiment, the container lid may be a one piece and unitary lid.

As will be understood by one of ordinary skill in the art, the container lid discussed herein may be used for sealing containers used for storing any variety of materials, including, but not limited to: food, paints, oils, consumer goods, construction materials, inks, chemicals, lubricants, adhesives, coatings, roofing mastics, driveway sealers, flavorings, sanitation supplies, building products, ice melt compounds, powders, pet food, and other such materials. The container lid may be formed from any suitable material or materials for storing or transporting such materials. In various embodiments, the container lid is manufactured from plastic (e.g., polyethylene, high-density polyethylene, etc.). In particular embodiments, the container lid is manufactured from a metal or composite material.

As will be described in greater detail throughout the disclosure, the u-shaped castellated cork seal provides benefits over traditional container lids, such as: 1) cantilevered support for the container lid seal; 2) increased support across the container lid when stacking containers; 3) reduced protrusion of a u-shaped cork into a container body without compromising the strength of the container lid seal; and 4) reduced trapping or adherence of materials stored within a container body, such as paint, around portions of the container lid.

Figure 1:
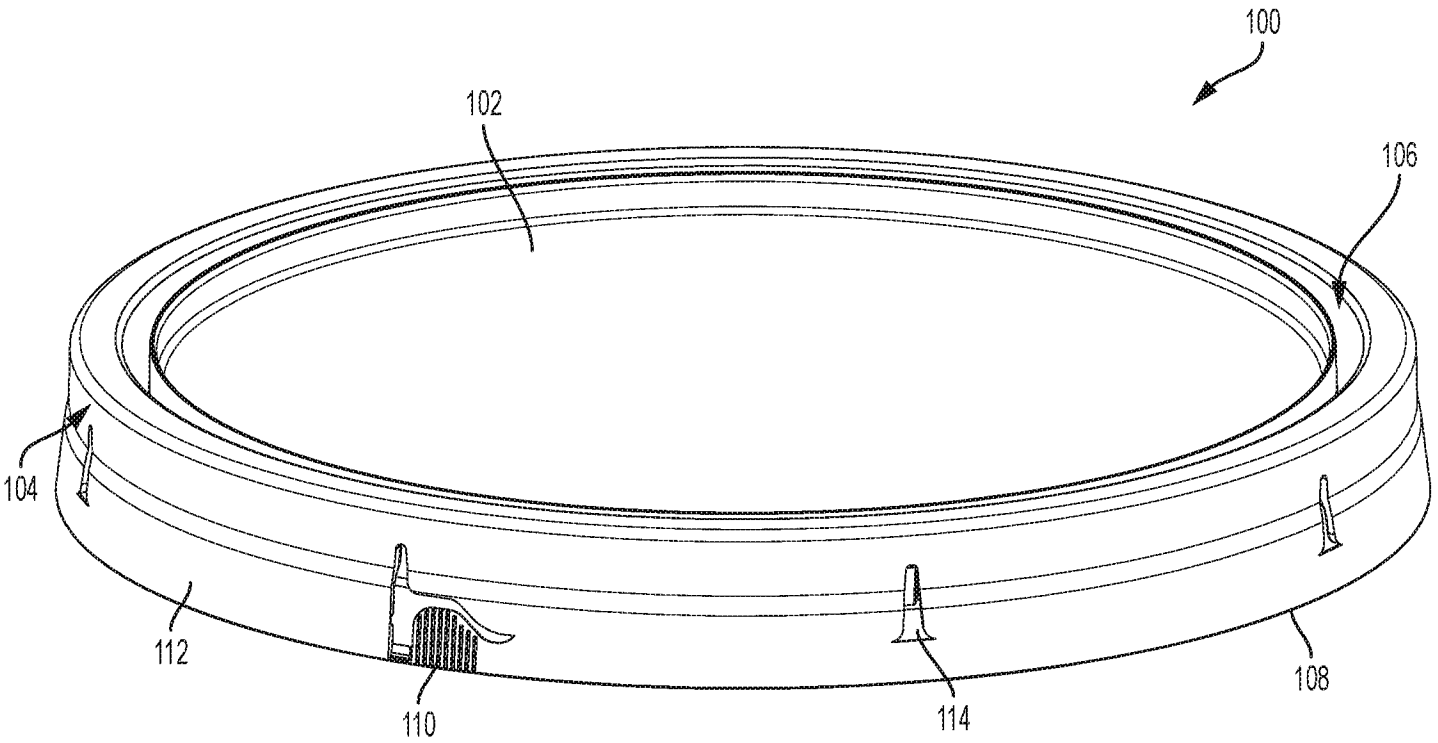
FIG. 1 is a top perspective view of an exemplary container lid, according to one aspect of the present disclosure.

Referring now to the figures, FIG.1 shows a top perspective view of an exemplary container lid 100, according to one embodiment of the present disclosure. As mentioned briefly above, the exemplary container lid 100 is configured to be securely positioned on the top of a container, such as a paint container, a general bucket for transporting materials, or any other appropriate container, and to further provide a gasketless leak-resistant seal when securely positioned on the top of the container. Accordingly, and in various embodiments, the exemplary container lid 100 includes a top surface 102 and an outer wall 104. In the present embodiment, the top surface 102 is substantially circular-shaped for covering or spanning the top opening of a container, although, it should be understood from the disclosure herein that the top surface 102 may be any suitable shape.

In particular embodiments, the outer wall 104 may serve as the outermost surface or perimeter of the container lid 100. Furthermore, the top surface 102 and the outer wall 104 are separated (or integrally joined) by a depression cavity 106, where the depression cavity 106 includes various lid components described in further detail below in the discussion associated with FIGS. 7 and 8. In particular embodiments, the depression cavity 106 includes a plurality of undulating or "castellated" surfaces which together form a cork-like seal on the container, and also form a surface suitable to receive one or more additional containers in stacked configurations (i.e., the bottom of a container is accepted in the depression cavity 106).

In various embodiments, when the exemplary container lid 100 is securely positioned on top of a container, the castellated cork extends downward into the container body. In one embodiment, the downward extension of the castellated cork into the container body provides cantilevered support, wherein the bottom most portion of an outer rim 108 of the container lid 100 extends downward (outside of the container body) to an elevation below the components of the castellated cork ("peaks" and "troughs" to be discussed below).

In certain embodiments, the cantilevered support provided by the castellated cork structure prevents a handler of the container lid 100 from easily removing the container lid 100 from a container without removing a tear strip 110. For example, consider a handler attempting to remove the container lid 100 from a paint bucket. In order for the handler to remove the container lid 100, the handler may lift or pry the container lid 100 upward and at an angle, thereby pulling the bottom most portion of the outer rim 108 of the container lid 100 away from the body of the container. In various embodiments, and in response to the outer rim 108 of the container lid 100 being pulled away from the container body, the cantilevered structure of particular components of the container lid (such as the castellated cork) may press into the inner body of the container with a substantially equal force, thereby preventing the container lid 100 from easily being removed. According to various aspects of the present disclosure, the castellated cork does not prevent the container lid 100 from being removed from a container, but rather provides additional support and prevents the lid 100 from being easily removed.

Continuing with FIG. 1, and shown in the present embodiment, the tear strip 110 is included along the bottom most portion of the outer rim 108. According to various aspects of the present disclosure, the container lid 100 may be secured onto the top of a container with the tear strip 110 intact. Further, a handler of the container lid 100 may remove the tear strip 110 by peeling the tear strip 110 away from the exemplary container lid 100. In various embodiments, removing the tear strip 110 reveals a plurality of pull tabs 112 that a user may use to grip onto and pull (outward and upward) from when removing the container lid 100 from a container. In certain embodiments, removing the tear strip 110 also reveals a plurality of gaps 114 separating the plurality of pull tabs 112. In one embodiment, the plurality of gaps 114 define each of the plurality of pull tabs 112 and allow for a particular portion of the exemplary lid 100 (e.g., a pull tab 112) to be pulled away from a container for removing the exemplary lid 100.

As discussed above, in some embodiments, without the plurality of gaps 114 separating the plurality of pull tabs 112, removing the exemplary container lid 100 may be a cumbersome task for a handler of the lid 100. For example, pulling on one of the plurality of pull tabs 112 effectively allows for the portion of the exemplary lid 100 corresponding to the pull tab 112 to become unsealed (e.g., the pull tab 112) because that particular portion may be pulled while the remainder of the lid 100 remains secured to the exemplary lid 100. Continuing with the above example, if the exemplary container lid 100 did not include the plurality of pull tabs 112, a handler may need to pull a larger portion of the container lid 100 (e.g., an entire side of the lid) to disengage the lid 100 from the container. In particular embodiments, at least a portion of the tear strip 110 and the plurality of pull tabs 112 form the container lid 100 outer wall 104.

Figure 2:
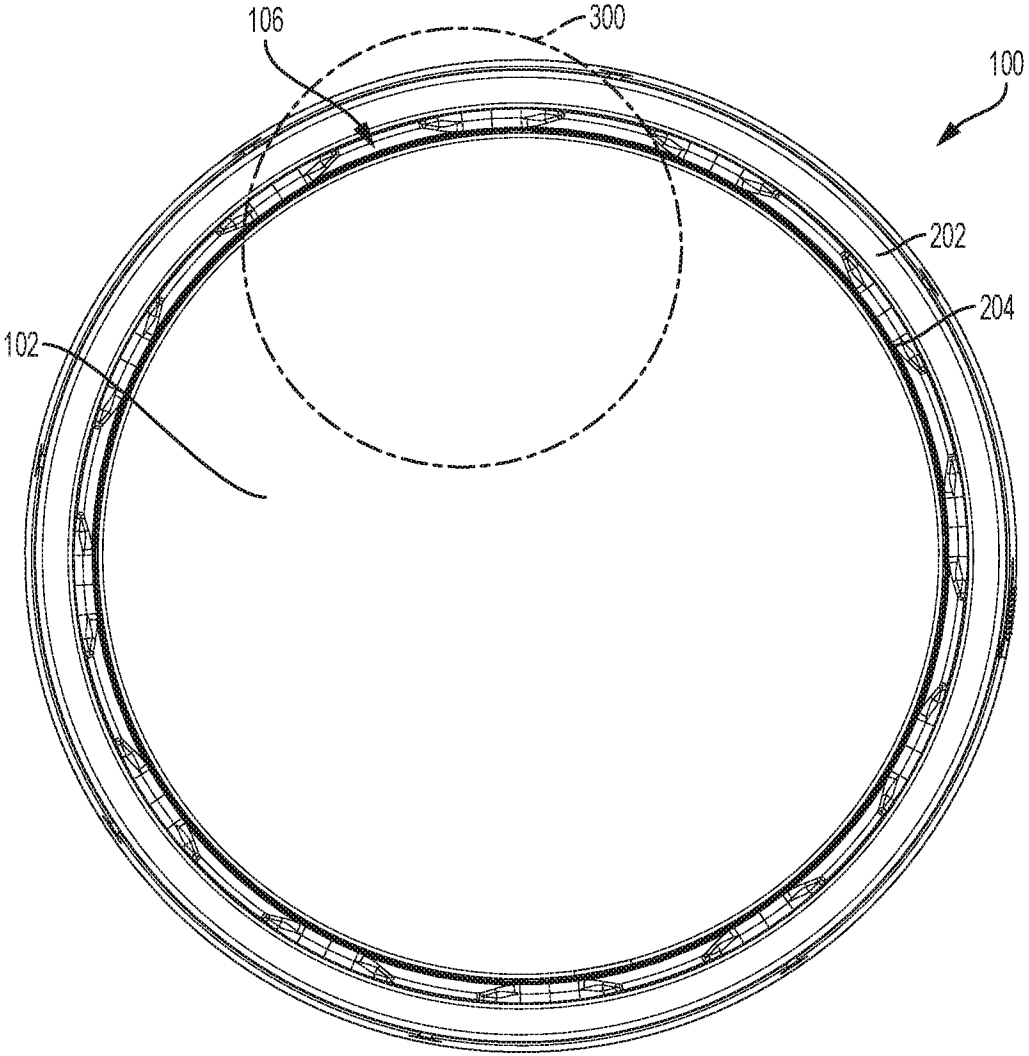
FIG. 2 is a top view of an exemplary container lid, according to one aspect of the present disclosure.

Turning now to FIG. 2, a top view of the exemplary lid 100 is shown, according to one aspect of the present disclosure. As shown in the present embodiment, the depression cavity 106 extends circularly around the container lid 100, proximate to an upper outer rim 202, where the upper outer rim 202 is an uppermost portion of the outer wall 104 (not shown). In a particular embodiment, adjacent to the depression cavity 106 is an upper rim 204, which protrudes upwardly from the top surface 102 of the container lid 100. As shown in the present embodiment, an area 300 indicates a portion of the container lid 100 to be described in greater detail below in the discussion of FIG. 3.

Figure 3:
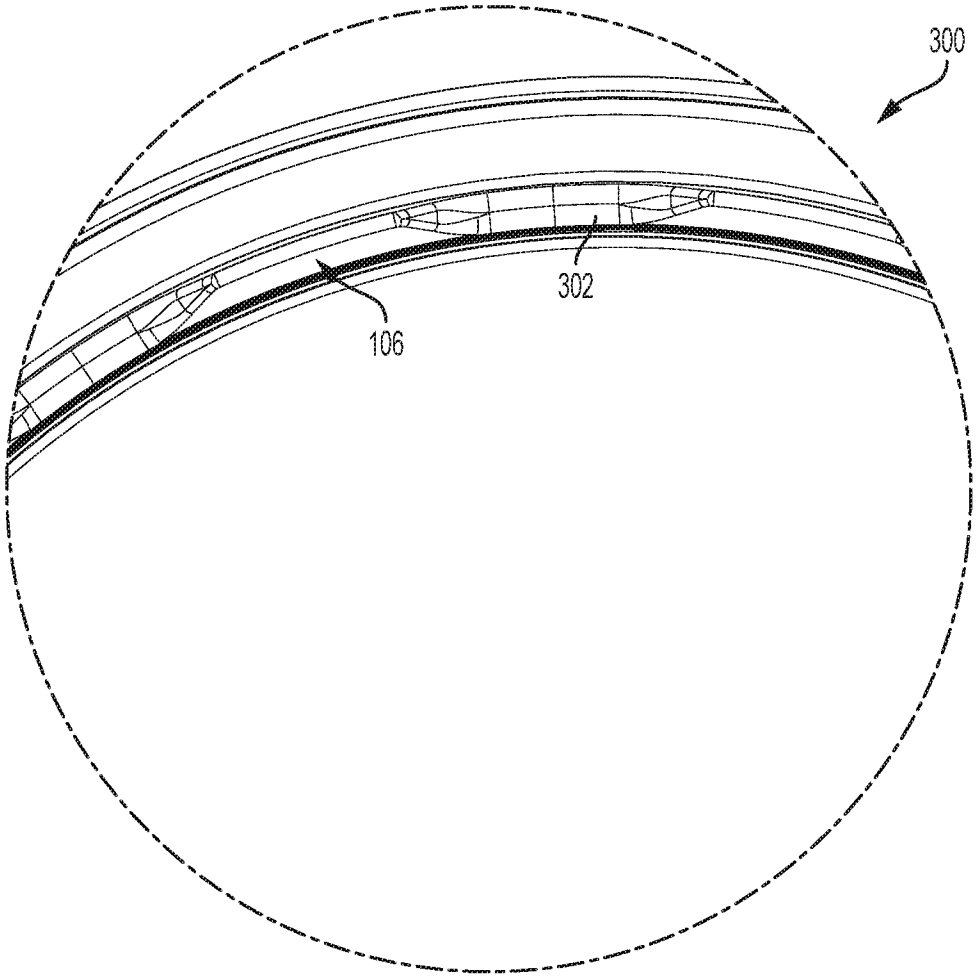
FIG. 3 is a partial view of an exemplary container lid, according to one aspect of the present disclosure.

In one embodiment, FIG. 3 illustrates a top view of the area 300, a particular portion of the exemplary container lid 100. In the present embodiment, the depression cavity 106 is shown including periodic lengths of a surface, a cork surface 302, where the cork surface 302 may accept one or more additional containers in stacked configurations. According to various aspects of the present disclosure, the cork surface 302 corresponds reciprocally to peaks of the castellated cork on the underside of the container lid 100, as will be described in greater detail below in association with the discussion of FIG. 4.

Figure 4:
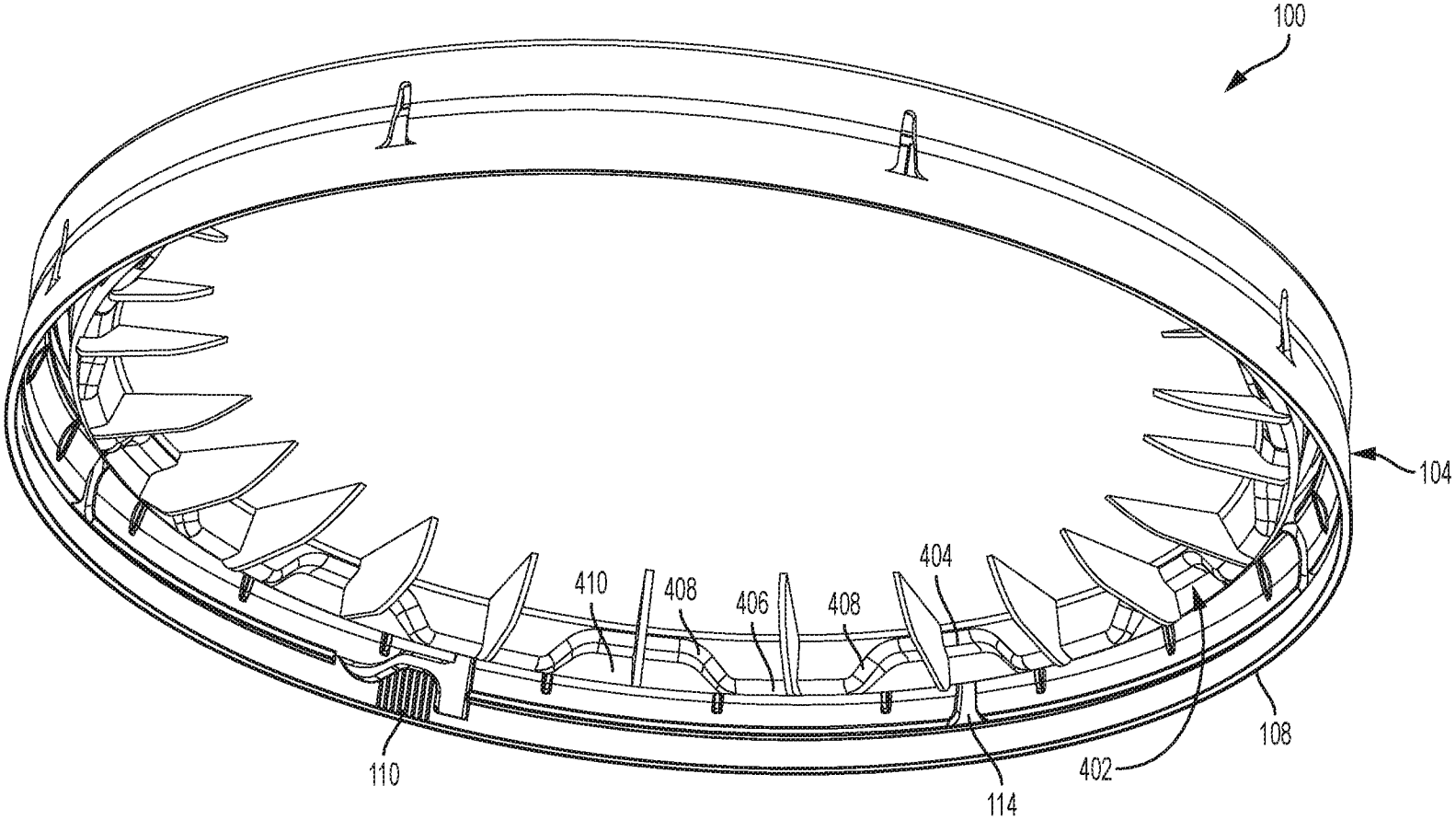
FIG. 4 is a bottom perspective view of an exemplary container lid, according to one aspect of the present disclosure.

Referring now to FIG. 4, a bottom perspective view of the exemplary container lid 100 is shown, according to one aspect of the present disclosure. In particular embodiments, and mentioned briefly above, the exemplary container lid 100 is configured to be securely positioned on the top of a container, such as a paint container, a general bucket for transporting materials, or any other appropriate container, and to further provide a leak-resistant seal when securely positioned on the top of the container. According to various aspects of the present disclosure, and shown in the present embodiment, the container lid 100 includes a protruding castellated cork 402 for at least partially providing the leak-resistant seal. In one embodiment, the castellated cork 402 includes alternating and undulating peaks 404 and troughs 406, where a trough 406 of the castellated cork 402 extends further downward into a container than a peak 404 when the exemplary lid 100 is in a closed position on top of a container. In particular embodiments, a sloped wall 408 integrally connects the peaks 404 and troughs 406 between the highest and lowest portions of the peaks 404 and troughs 406. In some embodiments, a portion of the castellated cork 402 maintains a constant extended length (e.g., protrusion elevation) around the circumference of the castellated cork 402, as shown at the cork portion 410.

Figure 5:
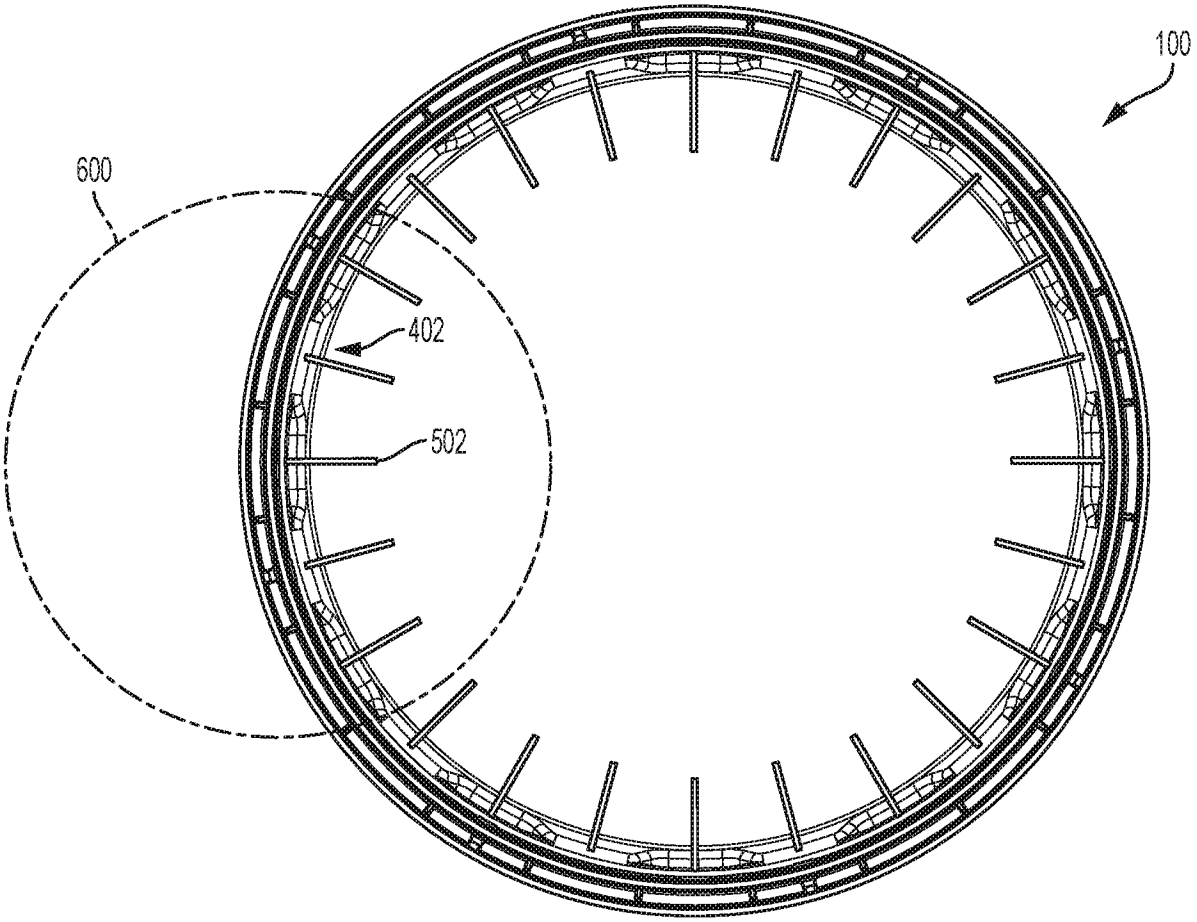
FIG. 5 is a bottom view of an exemplary container lid, according to one aspect of the present disclosure.

Turning now to FIG. 5, a bottom view of the exemplary lid 100 is shown, according to one embodiment of the present disclosure. As shown in the present embodiment, the container lid 100 may include vertical support ridges 502 perpendicular to the castellated cork seal 402 for providing additional structural support. In various embodiments, the vertical support ridges 502 are integrally connected to the underside of the top surface 102 of the container lid 100, as well as integrally connected to various locations along the castellated cork 402 surface. According to various aspects of the present disclosure, the vertical support ridges 502 disperse pressure applied to the castellated cork 402 into the underside of the top surface 102 (or vice versa) when additional containers are stacked onto the exemplary container lid 100 or when a force is being applied to remove the lid 100 from a container.

In some embodiments, the vertical support ridges 502 are generally triangularly shaped. In other embodiments, the vertical support ridges 502 may be quadrant shaped, or any other appropriate shape. In some embodiments, the container lid 100 includes no support ridges 502. As shown in the present embodiment, an area 600 indicates a portion of the container lid 100 to be described in greater detail below in association with the discussion of FIG. 6.

Figure 6:
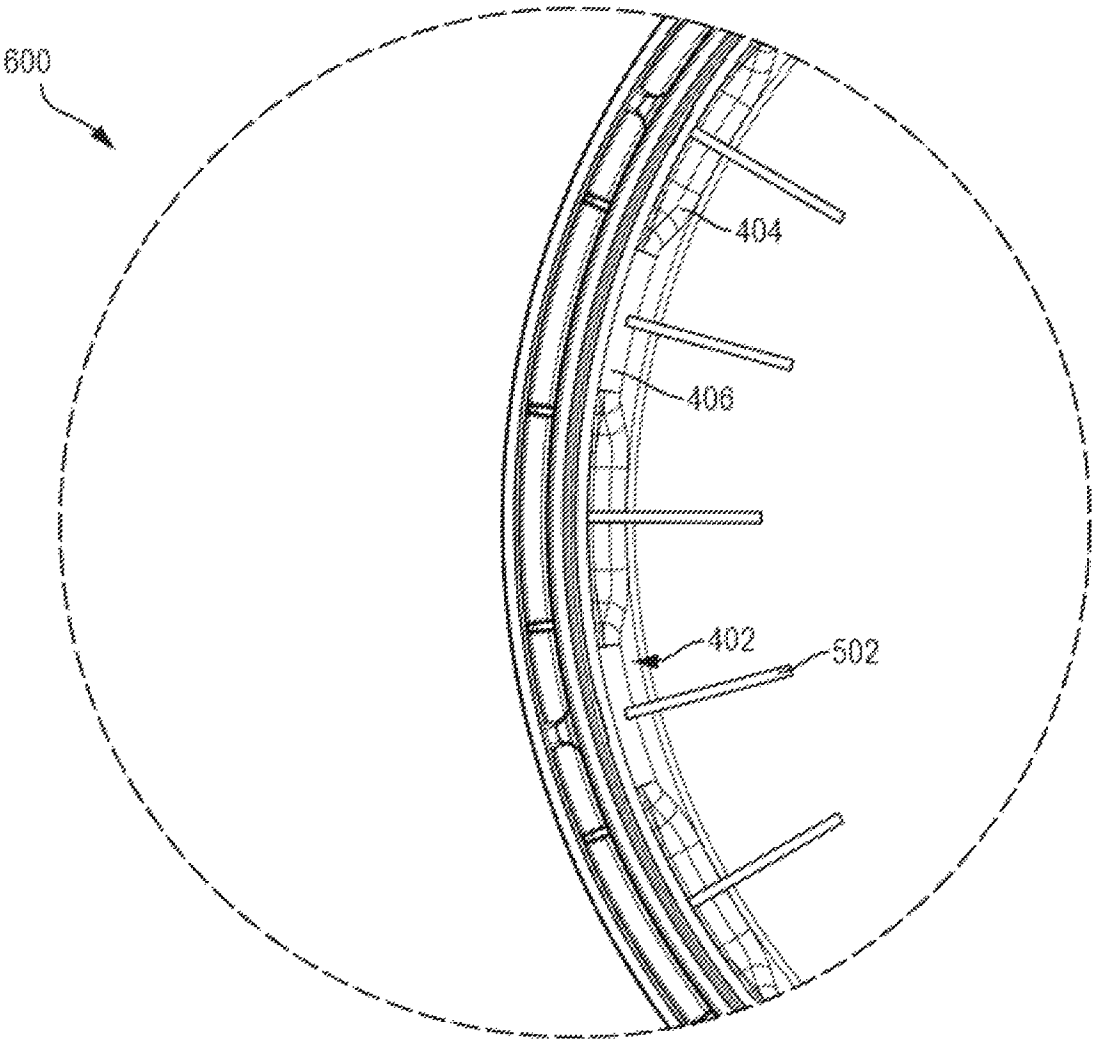
FIG. 6 is a partial view of an exemplary container lid, according to one aspect of the present disclosure.

Referring now to FIG. 6, a view of the area 600, a particular portion of the exemplary container lid 100, is shown according to one aspect of the present disclosure. As shown in the present embodiment, and discussed briefly above, the vertical support ridges 502 may be integrally connected to the peaks 404, the troughs 406, the cork portion 410 (not shown), or any other suitable portion of the castellated cork 402. According to various aspects of the present disclosure, any number of support ridges 502 may be included on the container lid 100 (as appropriate), and the support ridges may be positioned in various configurations (as appropriate). For example, each peak 404 and/or trough 406 may include one bisecting support ridge 502, or each peak 404 and/or trough 406 may include multiple support ridges 502 of regular or irregular spacing. In some embodiments, the peaks 404 and/or troughs 406 may not include any support ridges 502.

Figure 7:
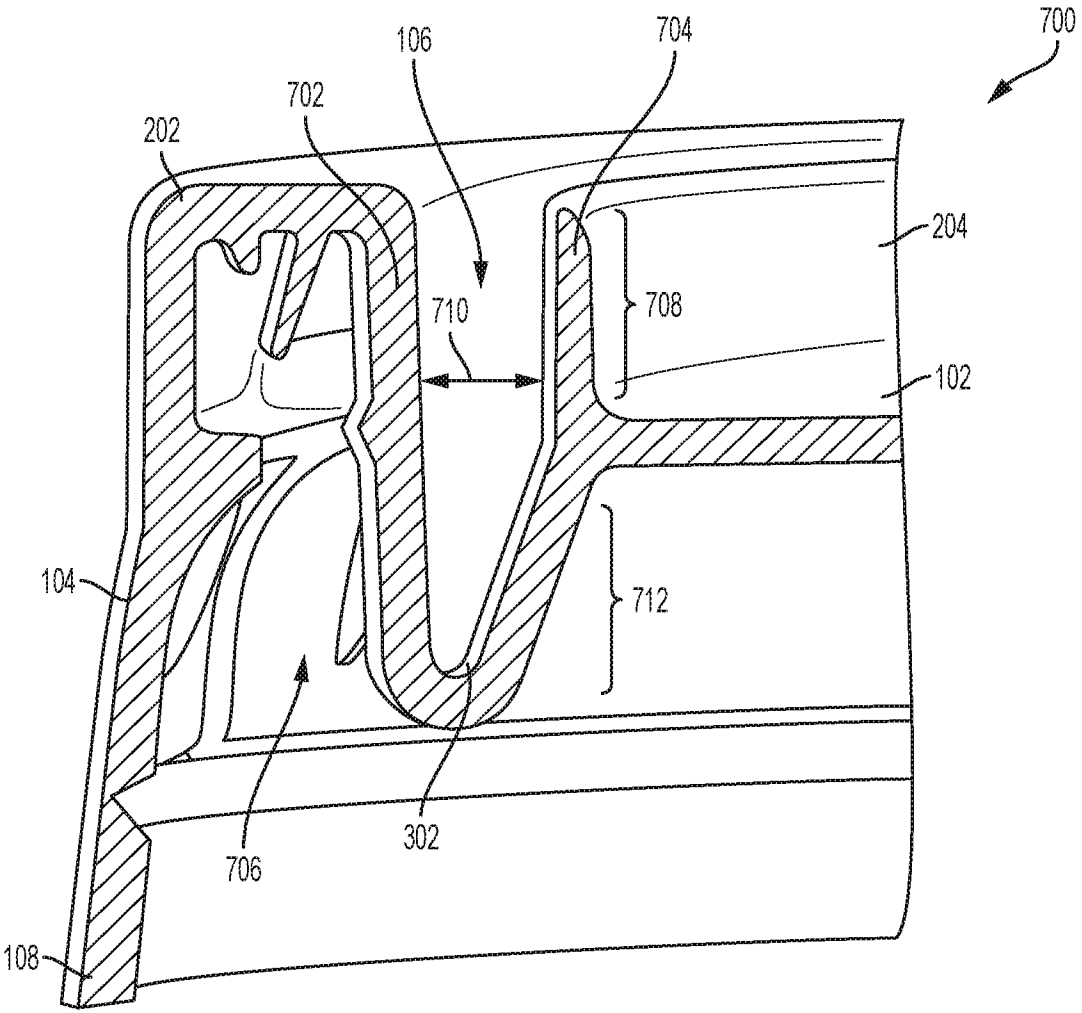
FIG. 7 is a cross-sectional view of an exemplary container lid illustrating a castellated cork seal structure, according to one aspect of the present disclosure.

Turning now to FIG. 7, a cross section through a trough 406 of the castellated cork 402 is shown, according to one aspect of the present disclosure. In the present embodiment, the depression cavity 106 is shown extending downward to a cork surface 302. In certain embodiments, the cork surface 302 undulates in elevation around the depression cavity 106 reciprocal to the configuration of both the peaks 404 and troughs 406, and the bottom of a container may be accepted at the portions of the cork surface 302 corresponding to the reciprocals of the peaks 404.

Continuing with FIG. 7, in particular embodiments, the depression cavity 106 is defined by a seal portion side wall 702 and a rim side wall 704 (or "perpendicular rim"), according to various aspects of the present disclosure. In one embodiment, a seal portion 706 of the container lid 100 is located in a space between the container lid outer wall 104 and the seal portion side wall 702. The seal portion 706 may include one or more seal surfaces for providing a gasketless seal on a container, aspects of which are further described in U.S. Pat. No. 8,181,819, filed Mar. 5, 2005, entitled "Lid and Container," as well as in U.S. Pat. No. 7,963,419, filed Oct. 10, 2006, and entitled "Lid and Container," both of which are incorporated herein by reference in their entireties. In a particular embodiment, the seal portion side wall 702 extends downward from the upper outer rim 202 to a distance/elevation that is less extended than the outer rim 108 (e.g., the outer rim 108 extends further downward than the seal portion side wall 702). In the embodiment shown in FIG. 7, the upper rim 204 protrudes upward from the top surface 102 of the lid and extends around a radial circumference of the container lid 100.

In one embodiment, the cross section shown in FIG. 7 illustrates an upper portion 708 of the depression cavity 106 that maintains a substantially constant width 710 between the seal portion side wall 702 and the rim side wall 704, and a lower portion 712 (the remainder) of the depression cavity 106 begins to taper downward to the cork surface 302 according to the corresponding trough 406 protruding from the bottom of the container lid 100. As shown, the cork surface 302 at the trough 406 has a smaller cross-section than the substantially constant width 710.

Figure 8:
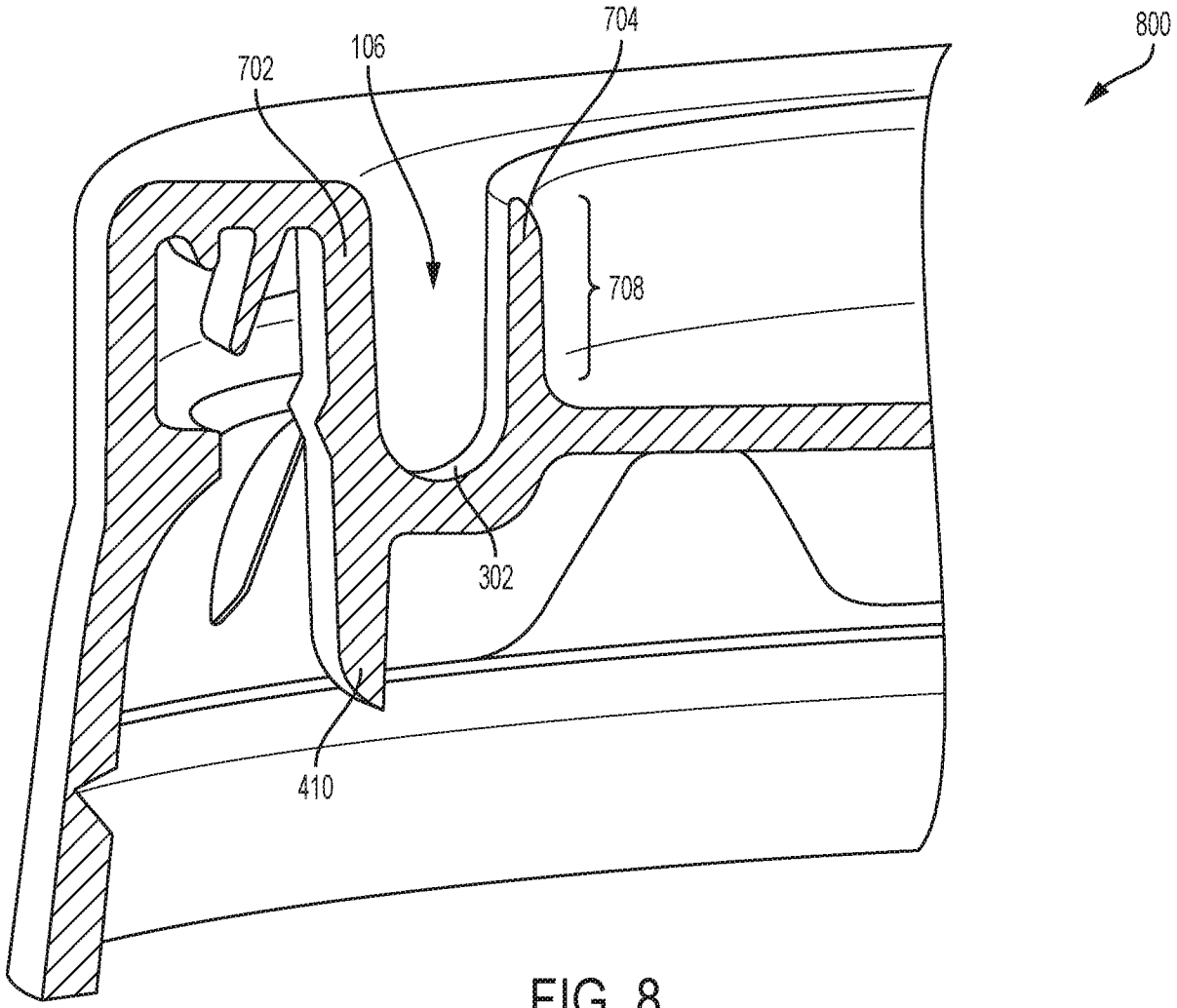
FIG. 8 is a cross-sectional view of an exemplary container lid illustrating a castellated cork seal structure, according to one aspect of the present disclosure.

Turning to FIG. 8, a cross section through a peak 404 of the castellated cork 402 is shown, according to one embodiment of the present disclosure. In the present embodiment, the upper portion 708 of the depression cavity 106 is substantially similar to the upper portion 708 shown in FIG. 7; however, the bottom portion of the castellated cork 402 has sloped upward such that the cork surface 302 in FIG. 8 is at a higher elevation than the cork surface 302 shown in FIG. 7. According to various aspects of the present disclosure, when the cork surface 302 corresponds to the elevation at a peak 404, as shown in FIG. 8, the cork surface 302 may accept the bottom of a stacked container.

Also shown in the present embodiment is the cork portion 410. In one embodiment, the cork portion 410 remains at a constant elevation despite the undulation of the peaks 404 and troughs 406 of the castellated cork 402. In particular embodiments, the undulating peaks 404 and troughs 406 are substantially u-shaped (when viewed in a cross section) while the cork portion 410 narrows to a point. In various embodiments, the cork portion 410 is integrally connected to the outer most portion of the castellated cork 402.

In one embodiment, the cork portion 410 acts as a support wall and provides increased structural support to the undulating peaks 404 and troughs 406. In some embodiments described herein, the cork portion 410 is described as an integral part of the castellated cork 402, forming a wall of the castellated cork 402. As will be understood, in some embodiments, the cork portion 410 that spans between the undulating peaks 404 and troughs 406 may not be integrally formed with the castellated cork 402, but may be separate components of the container lid coupled to portions of the castellated cork 402.

According to various aspects of the present disclosure, including the cork portion 410 between the undulating peaks 404 and troughs 406 of the castellated cork 402 may provide additional structural support for the container lid and may help eliminate the need for other support structures, including support ribs or small vertical walls/notches within the depression cavity 106 (a common practice in traditional lid design). Accordingly, the cork portion 410, as shown in the present embodiment, provides an improvement over traditional container lids.

According to particular aspects of the present disclosure, sloped walls integrally connect the peaks 404 and troughs 406 between the highest and lowest portions of their respective elevations. In one embodiment, the sloped walls are an integral part of the castellated cork 402 and provide load bearing support to the container lid 100 when the container lid 100 is supporting the weight of one or more containers stacked on top of it. As seen in the present embodiment, two sloped walls connect one peak 404 of the castellated cork 402 with two troughs 406 and the resulting structure is similar to a truss. In certain embodiments, the truss-like structure (e.g., the u-shaped castellated cork 402) formed as a result of the sloped walls integrally connecting to the peaks 404 and troughs 406 may eliminate the need for support ribs within the depression cavity 106. Such support ribs may induce stress points in a lid design and utilizing a castellated cork (e.g., castellated cork 402) may eliminate these stress points and result in a container lid with better structural qualities.

In various embodiments, the peaks 404 of the cork surface 302 may vary in length and frequency. For example, and in some embodiments, there may be many shorter (e.g., 1 inch in length) peak 404 portions of the cork surface 302 within the depression cavity 106, or there may be fewer, longer (e.g., 3 inches in length) peak 404 portions of the cork surface 302 within the depression cavity 106. In various embodiments, the configuration and ratio of the length and frequency of the length of the undulation of the cork surface 302 is optimized to disperse the stress upon the exemplary container lid 100 when additional containers are stacked thereon. Other types of container lids may include small vertical walls/notches to accept the bottom of a stacked container. Stacking one or more containers upon these traditional container lids may eventually break or compromise the structural integrity of the small vertical walls/notches, which may further compromise the fidelity of the container lid seal. Other traditional container lids may not include any particular location/lid portion for accepting the bottom of a stacked container, and rather the traditional container lid may accept the entire circumference of the container bottom at the bottom of a u-shaped cork. In this scenario, it is common for the containers to become stuck in the stacked configuration. The present embodiments provide improvements over traditional container lids that accept the bottom of a stacked container by providing the undulating cork surface 302, wherein the bottom of a stacked container is accepted at the portions of the cork surface 302 that are at an elevation above a lower portion of the cork surface 302 (e.g., at a peak 404).

Traditionally, container lids including downwardly protruding components for improved seals may extend further into a container, collecting or trapping the product contained therein. For example, consider a traditional container lid (without a castellated cork seal) in a secured position on top of a paint can/container. Typically, different paints mixed to form a desired color will separate during storage (or after a certain period of time), where one color rises to the top of the container and the other color(s) settle in layers below. In this example, the surface area of the downwardly protruding component may collect and trap at least some of the paint near the top of the container, thereby creating a disproportionate ratio of colors in the paint due to certain paint colors of a mixture rising to the top and becoming trapped by the lid. According to the present disclosure, aspects of the disclosed embodiments aim to resolve this issue by including a castellated cork 402, rather than a single width and height component, in order to reduce the surface area of the lid that may potentially come into contact with the matter stored within container.

CONCLUSION

Accordingly, it will be readily understood by those persons skilled in the art that, in view of the above detailed description of the various embodiments and articles of the present disclosure, the present disclosure is susceptible of broad utility and application. Many methods, embodiments, and adaptations of the present disclosure other than those herein described, as well as many variations, modifications, and equivalent arrangements will be apparent from or reasonably suggested by the present disclosure and the above detailed description thereof, without departing from the substance or scope of the present disclosure. Accordingly, while the present disclosure is described herein in detail in relation to various embodiments, it is to be understood that this detailed description is only illustrative and exemplary of the present disclosure and is made for purposes of providing a full and enabling disclosure of the present disclosure. The detailed description set forth herein is not intended nor is to be construed to limit the present disclosure or otherwise to exclude any such other embodiments, adaptations, variations, modifications, and equivalent arrangements of the present disclosure. The scope of the present disclosure is defined solely by the claims appended hereto and the equivalents thereof

What is claimed is:

1. A gasketless container lid comprising:
- a top portion;
- a side portion comprising a detachable tear strip; and
- a castellated cork seal mechanism, the castellated cork seal mechanism comprising:
  - at least one first portion comprising a substantially u-shaped protrusion extending downwardly from the lid top portion to a first particular depth; and
  - at least one second portion integrally connected to the first portion comprising a substantially u-shaped protrusion extending downwardly from the lid top portion to a second particular depth.

2. The gasketless container lid of claim 1, wherein the second particular depth is greater than the first particular depth.

3. The gasketless container lid of claim 2, wherein the castellated cork seal mechanism further comprises at least one third portion, the at least one third portion comprising a substantially flat protrusion extending downwardly from a bottom of the at least one first portion to a third particular depth.

4. The gasketless container lid of claim 3, wherein the third particular depth is substantially the same depth as the second particular depth.

5. The gasketless container lid of claim 3, wherein the third particular depth is not the same depth as the second particular depth.

6. The gasketless container lid of claim 3, wherein the container lid further comprises one or more ribs extending downwardly from a bottom of the container lid, a first rib of the one or more ribs integrally formed with at least a portion of the at least one first portion of the castellated cork seal mechanism and perpendicular thereto.

7. The gasketless container lid of claim 6, wherein a second rib of the one or more ribs is integrally formed with at least a portion of the at least one second portion of the castellated cork seal mechanism and perpendicular thereto.

8. The gasketless container lid of claim 7, wherein a third rib of the one or more ribs are integrally formed with at least a portion of the at least one third portion of the castellated cork seal mechanism and perpendicular thereto.

9. The gasketless container lid of claim 1, wherein the container lid is substantially circular.

10. The gasketless container lid of claim 1, wherein the container lid is substantially rectangular.

11. The gasketless container lid of claim 1, wherein the castellated cork seal mechanism extends linearly at a position proximate the perimeter of the container lid and in substantially the same shape as the container lid.

12. The gasketless container lid of claim 1, wherein the side portion extends below a lowest point of the castellated cork seal mechanism.

13. The gasketless container lid of claim 1, wherein the detachable tear strip extends below a lowest point of the castellated cork seal mechanism.

14. A gasketless container lid comprising:

a top surface at a first elevation terminating at a perpendicular rim extending upwardly to a second elevation;

a seal portion comprising a seal surface at substantially the second elevation terminating at a side wall extending downwardly from the second elevation, wherein the side wall comprises a removably attached tear strip;

a cork seal comprising:

a first portion extending downwardly from the seal portion substantially perpendicular to the seal surface at the second elevation to a third elevation; and a second portion extending downwardly from the rim at the second elevation, the second portion forming an undulating cork surface between the first portion and second portion, wherein a first section of the undulating cork surface is at the third elevation and a second section of the undulating cork surface is at a fourth elevation.

15. The gasketless container lid of claim 14, wherein the container lid comprises a channel comprising at least some of the first portion, the second portion, and the undulating cork surface between the seal portion and the rim for receiving a protrusion from a bucket stacked on the container lid.

16. The gasketless container lid of claim 15, wherein the protrusion from the bucket stacked on the container lid rests upon the undulating surface at the fourth elevation.

17. The gasketless container lid of claim 14, wherein the fourth elevation is between the first elevation and the third elevation.

18. The gasketless container lid of claim 14, wherein the undulating cork surface slopes from the third elevation to the fourth elevation.

19. The gasketless container lid of claim 18, wherein the container lid further comprises one or more ribs integrally formed with a cork surface of the container lid, the one or more ribs perpendicular to the cork surface and each connected to a least a portion of the channel.

* * * * *